US005177540A

United States Patent [19]

Honda et al.

[11] Patent Number: 5,177,540

[45] Date of Patent: Jan. 5, 1993

[54] DEVELOPER CONTAINER, DEVELOPER UNIT AND PROCESS CARTRIDGE HAVING THE DEVELOPER UNIT

[75] Inventors: Mitsuru Honda, Kashiwa; Eiji Funabashi, Kawasaki, both of Japan

[73] Assignee: Canon Kabushiki Kaisha, Tokyo, Japan

[21] Appl. No.: 852,723

[22] Filed: Mar. 17, 1992

[30] Foreign Application Priority Data

Mar. 20, 1991 [JP] Japan ..... 3-081773

[51] Int. Cl.[5] ..... G03G 15/08

[52] U.S. Cl. ..... 355/260; 355/210; 355/245; 222/DIG. 1; 229/123.1

[58] Field of Search ..... 355/260, 210, 211, 245; 222/541, DIG. 1; 229/123.1, 125.35

[56] References Cited

U.S. PATENT DOCUMENTS

| | | | |
|---|---|---|---|
| 4,615,608 | 10/1986 | Mizutani | 222/DIG. 1 |
| 4,778,086 | 10/1988 | Shibata et al. | 222/DIG. 1 |
| 4,827,307 | 5/1989 | Zoltner | 355/260 X |
| 4,862,210 | 8/1989 | Wooley | 355/245 |
| 4,931,838 | 6/1990 | Ban et al. | 355/260 |
| 4,961,450 | 10/1990 | Furuta | 222/541 |
| 4,981,218 | 1/1991 | Ban et al. | 206/633 |
| 4,998,140 | 3/1991 | Satou | 355/245 |
| 5,018,560 | 5/1991 | Tsukamoto | 355/260 X |
| 5,027,156 | 6/1991 | Kobayashi | 355/245 |
| 5,030,998 | 7/1991 | Shibata | 355/260 |
| 5,080,745 | 1/1992 | Paull | 222/DIG. 1 |
| 5,101,871 | 4/1992 | Susumu | 355/260 |
| 5,110,645 | 5/1992 | Prestel et al. | 355/260 X |
| 5,134,441 | 7/1992 | Nagata et al. | 355/245 |

FOREIGN PATENT DOCUMENTS 59-13262 1/1984 Japan .

*Primary Examiner*—Richard L. Moses

*Attorney, Agent, or Firm*—Fitzpatrick, Cella, Harper & Scinto

[57] ABSTRACT

An opening of a developer container is sealed by a sealing member which is easy to tear in a predetermined direction. The sealing member is composed of a main portion having a tear strip portion, and a leader portion protruding from the main portion as an extension from the tear strip portion. The main portion seals the opening. The tear strip portion is torn off from the main portion by pulling the leader portion in the predetermined direction. The main portion is adhered to an adhesion area surrounding the opening. The adhesion area has a box-like area recessed in the predetermined direction, at a location facing a part of the main portion adjacent to the base portion of the tear strip portion.

24 Claims, 8 Drawing Sheets

DEVELOPER CONTAINER, DEVELOPER UNIT AND PROCESS CARTRIDGE HAVING THE DEVELOPER UNIT

BACKGROUND OF THE INVENTION

1. Field of the Invention

The present invention relates to a developer container which contains developing agent for developing an electrostatic latent image, a developer unit which develops an electrostatic latent image, and a process cartridge which comprises such a developer unit, as well as an image carrier of an electrostatic latent image, and which is removably set in an electrophotographic device.

2. Description of the Related Art

U.S. Pat. No. 4,981,218 discloses a developer container employing a sheet-like sealing member to seal a developer-discharging opening of the developer container body. Such a sealing member is adhered by heat-welding, etc., to an adhesion area surrounding the opening. When the developer container is to be used, the sealing member is peeled off from the adhesion area to clear the opening.

Since the sealing member must be adhered to the container body so as to be peeled off later, the above known art requires an accurate control of the adhesion strength therebetween. If the adhesion strength is rather weak, the sealing member may be easy for an operator to peel off, however, it is also more likely to peel off at an inopportune moment, e.g. during transportation, in which case a leakage of the developer may well result. Also when an operator peels off the sealing member, it sometimes tears leaving a piece thereof at the opening because of a scratch or a crack in the sealing member or damage thereof caused by the adhering process.

To solve such problems of the above known art, Japanese Pat. Laid-Open No. 59-13262 discloses art employing a sealing member which is easy to tear parallel to one specific straight line or which has a line with perforations, scoring, etc. to seal the above-mentioned opening. For use, a long strip portion is torn off from the sealing member to form a long opening in the sealing member.

In such art, however, there is a tendency for the strip portion being torn off to become narrower or wider as the tearing progresses. If the opening is formed with its width varying over the course of the tearing, the amount of developer supplied to the development chamber becomes uneven, i.e. it varies at different locations thereof.

U.S. Pat. No. 4,931,838 discloses art which solves such problems. In the art disclosed, a sealing member is provided with a tear tape adhered thereto, and, for use, the sealing member is torn to form an opening by pulling the tear tape.

However, the process of adhering the tear tape to the sealing member may add to production costs.

SUMMARY OF THE INVENTION

It is an object of the present invention to provide a sealing means in which a belt-like portion of a sealing member is torn off with substantially the same width over the course of the tearing to form a developer-discharging opening in the sealing member.

It is another object of the present invention to provide the above-described sealing means at a minimum cost.

According to the present invention, a developer container, a developer unit and a process cartridge all employ a sheet-like sealing member to seal the developer-discharging opening, which is easy to tear in a direction substantially parallel to one specific straight line. This sealing member comprises a main portion, which is adhered to the adhesion area surrounding the developer-discharging opening so as to seal the opening, a tear strip portion, which is a part of the main portion that is torn off in a predetermined direction, i.e. substantially parallel to the straight line, and a leader portion which extends from the tear strip portion of the main portion and which is folded back and laid in the predetermined direction. The adhesion area has a box-like area recessed in the predetermined direction, at a location facing a portion of the main portion that is adjacent to the base portion of the leader portion.

The further objects, features and advantages of the present invention will become apparent in the below description of the preferred embodiments with reference to the attached drawings.

DETAILED DESCRIPTION OF THE PREFERRED EMBODIMENTS

Figure 1:
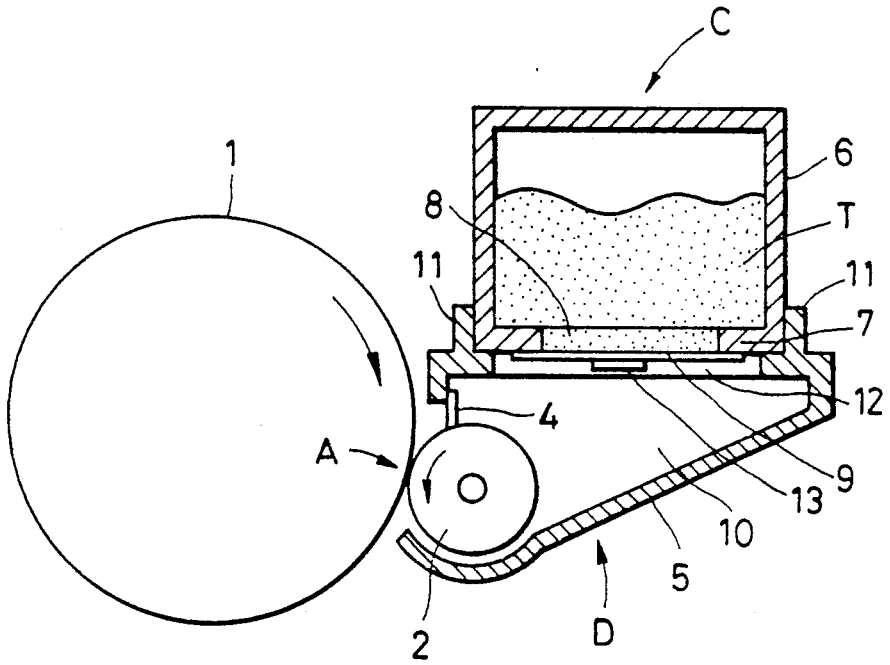
FIG. 1 illustrates a developer unit according to the present invention.

Referring to FIG. 1, an electrostatic latent image is formed by latent image forming means (not shown) on an electrophotographic photosensitive member 1 which is rotated in the direction indicated by the arrow. Then, the latent image is developed by a developer unit D.

The developer unit D comprises a main container 5 which is provided with a development roller 2. A development chamber 10 is formed inside the main container 5. Developer is supplied from a developer container (developer cartridge) C to the development chamber 10, where it is stored and applied to the developing roller 2.

The development roller 2 is rotated in the direction indicated by the arrow in FIG. 1 so as to convey the developer applied thereto to a development area A, where the developer on the roller 2 is applied to the photosensitive member 1 carrying the latent image. Thus, the latent image is developed. The thickness of the developer layer carried on the development roller 2 is regulated by a doctor plate 4 fixed to the main container 5.

The main container 5 has guide portions 11, along which the developer cartridge C is removably mounted to the developer unit D. The developer cartridge C is mounted or removed by sliding it into the main container 5 along the guide portions 11, in the axial direction of the development roller 2.

The developer cartridge C comprises the following: a container body 6 containing developer T; an opening 8 for letting out the developer T; and a sheet-like sealing member 9 sealing the opening 8 so as to prevent leakage of the developer T until it is desired to use the developer T.

To discharge the developer T, a strip portion of the sealing member 9 is torn off by pulling it lengthwise so as to make an opening in the sealing member 9, the opening extending in the axial direction of the development roller 2. The developer T is let out through the newly formed opening into the development chamber 10.

The main container 5 of the developer unit D is provided with an opening 12, through which the developer T discharged from the developer cartridge C as described above is let into the development chamber 10. In other words, the cartridge C is mounted on the developer unit D so that the opening 8 and sealing member 9 of the cartridge C fit the opening 12 of the main container 5.

When practically all the developer T in the developer cartridge C is let out into the development chamber 10, the cartridge C can be removed from the developer unit D.

Figure 2:
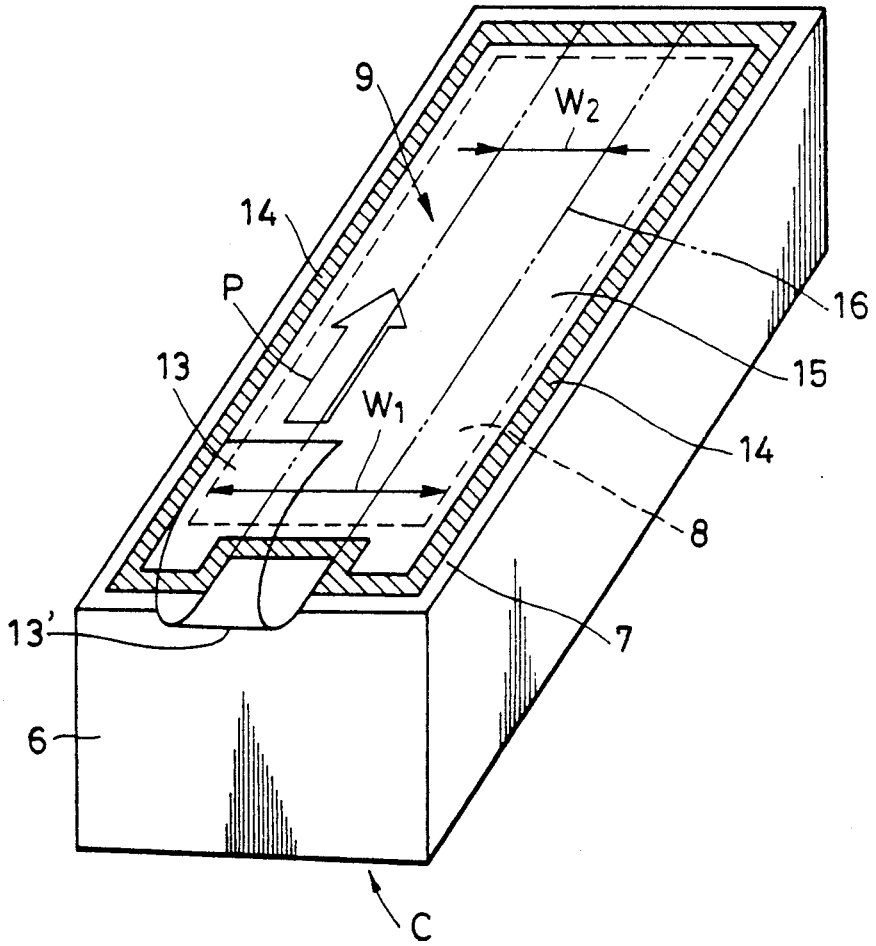
FIG. 2 is a perspective view of a developer container according to one embodiment of the present invention.

As shown in FIG. 2, the opening 8 extending lengthwise is formed at the bottom board of the container body 6. The opening 8 is sealed by the sheet-like sealing member 9. The sealing member 9 is fixed to an adhesion area 14 surrounding the opening 8 by using a heat sealing (heat welding) method, such as impulse sealing or high frequency welding. A method other than heat welding may be used to fix the sealing member 9 to the area 14. It is preferable that the area 14 be a continuous portion over the entire periphery of the container body 6.

The sealing member 9 is made of a sheet-like material which can be torn more easily in a direction substantially parallel to one straight line than in a direction substantially perpendicular to the same line. The sealing member 9 is fixed to the container body 6 so that the direction of the straight line (the easy-to-tear direction) substantially coincides with the lengthwise direction of the container body 6, i.e. the length direction of the opening 8.

Figure 4:
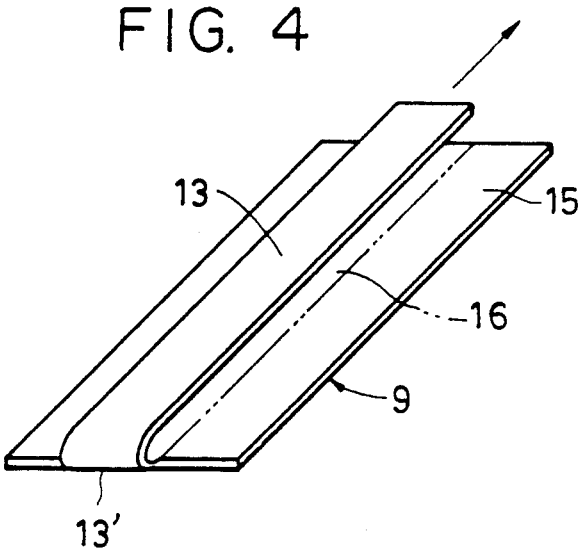
FIG. 4 is a perspective view of an example of a sealing member.

The sealing member 9 is composed of a main portion 15 which seals the opening 8, and a projection (a leader portion) 13 protruding from the main portion 15, as shown also in FIG. 4. The main portion 15 contains a tear strip portion 16 to be torn off which extends in the length direction of the container body 16. The tear strip portion 16 has a width $W_2$, which is a dimension perpendicular to the above length direction, less than the width of the opening 8, $W_1$, which is also perpendicular to the length direction of the container body 16. For example, the width $W_1$ is 60 mm, and the width $W_2$ 20 mm.

The projection 13 is an extension of the tear strip portion 16 and has a width equal to the width $W_2$. The projection 13 is folded in a pulling direction P, at a base portion 13' thereof adjacent to the main portion 15.

The pulling direction P is the direction in which the tear strip portion 16 is pulled and torn off from the main portion 15, i.e. the easy-to-tear direction of the sealing member 9.

When an operator, gripping the tip of the projection (leader portion) 13, pulls the projection 13, the tear strip portion 16 is torn off from the main portion 15 to form a developer-discharging opening extending lengthwise through the main portion 15. This tearing-off operation may be performed as the developer cartridge C is being slid along the guide 11 to be mounted on the developer unit D, as well as after it is mounted.

Figure 3:
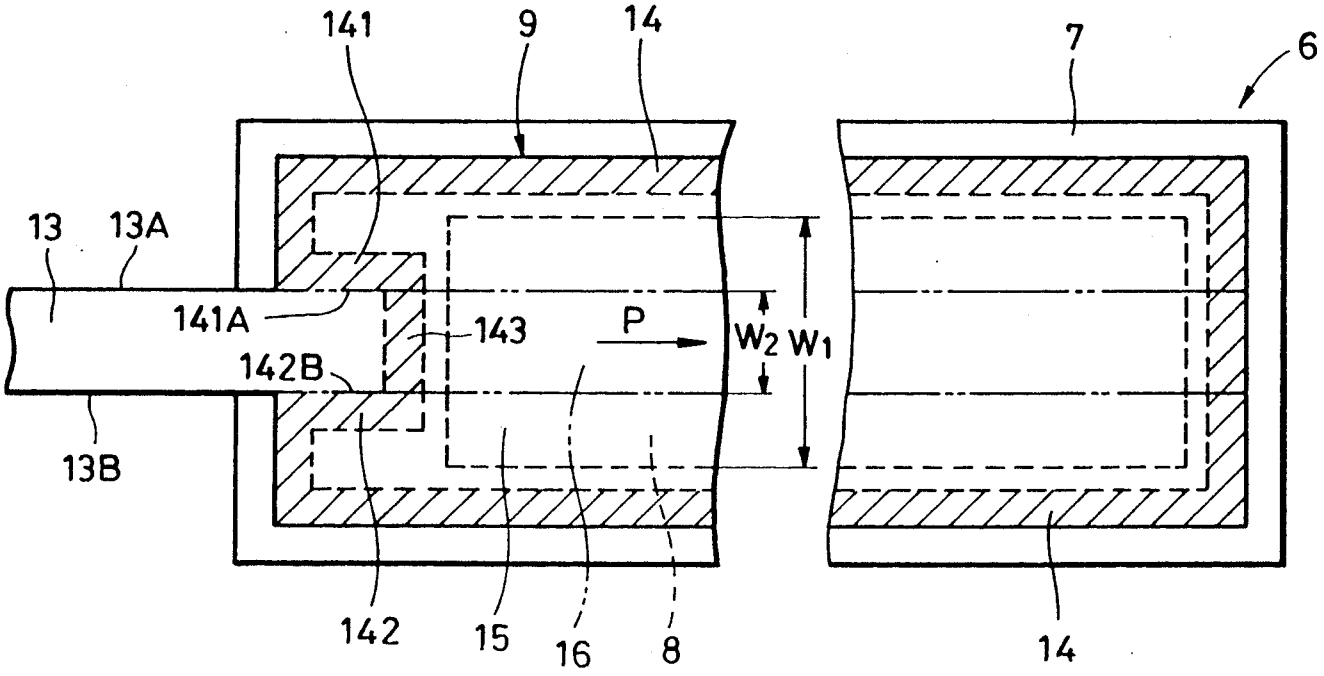
FIG. 3 is a bottom view of the developer container shown in FIG. 2.

As shown in FIG. 3, the above described adhesion area 14 has a box-like area recessed inwardly (in the direction indicated by the arrow P) at a location facing the base portion of the projection 13 of the sealing member 9.

The recessed box-like area is composed of first and second areas 141, 142 whose lengths extend substantially parallel to the direction P, and a third area 143 whose length extends perpendicularly to the direction P so as to connect the first and second areas 141, 142. One of the edge lines 13A along the length of the projection 13 of the sealing member 9 coincides with a line extended from the outside edge line 141A of the first area 141, and the other edge line 13B along the length of the projection 13 coincides with a line extended from the outside edge line 142B of the second area 142. Thus, the interval between the edge lines 141A and 142B equals the width $W_2$ of the projection 13. Naturally, each of the lines 141A, 142B is a border line between a portion of the sealing member 6 fixed to the container body 6 and a portion thereof not fixed thereto.

Since the main portion 15 is fixed to the first and second areas 141 and 142 respectively whereas the tear strip portion is not, breakage of the sealing member 9 will occur along the outside edge lines 141A, 142B of the two areas 141, 142 if the projection 13 is pulled in the direction indication by the arrow P. In other words, the tear strip portion 16 begins to rip with the width $W_2$. The width $W_2$ of the tear strip portion torn is maintained substantially the same throughout the length of the main portion 15. (Although the projection 13 is not folded in FIGS. 3, 5 and 6, it is, in actual practice, folded as shown in FIGS. 2 and 4.)

Figure 5:
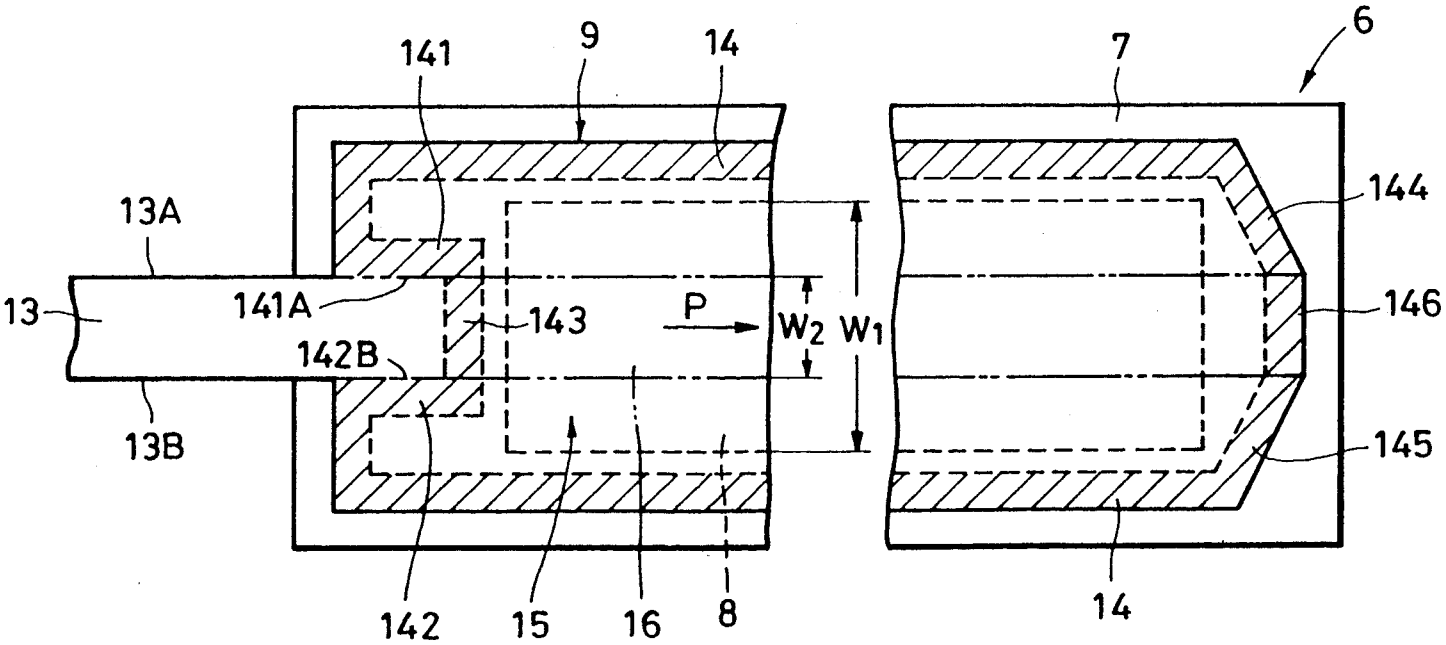
FIG. 5 is a bottom view of a developer container according to another embodiment of the present invention.

FIG. 5 shows another embodiment of the developer cartridge according to the present invention, in which the configuration of the adhesion area 14 is modified. The adhesion area 14 further comprises areas 144 and 145 which are provided at the end thereof where the tearing-off operation comes to an end. The areas 144 and 145 are formed so as to be interposed by the tear strip portion 16. The lengths of the areas 144 and 145 extend diagonally to the tearing direction indicated by the arrow P and are connected by an area 146 whose length is perpendicular to the tearing direction indicated by the arrow P. The areas 144 and 145 cause a reduction of the force which the adhesion area 14 receives at a final stage of the tearing-off operation, in which the tear strip portion 16 is torn off from the main portion 15, and ensure that the final end portion of the tear strip portion 16 will be smoothly removed from the main portion 15 with the width $W_2$ thereof maintained.

Figure 6:
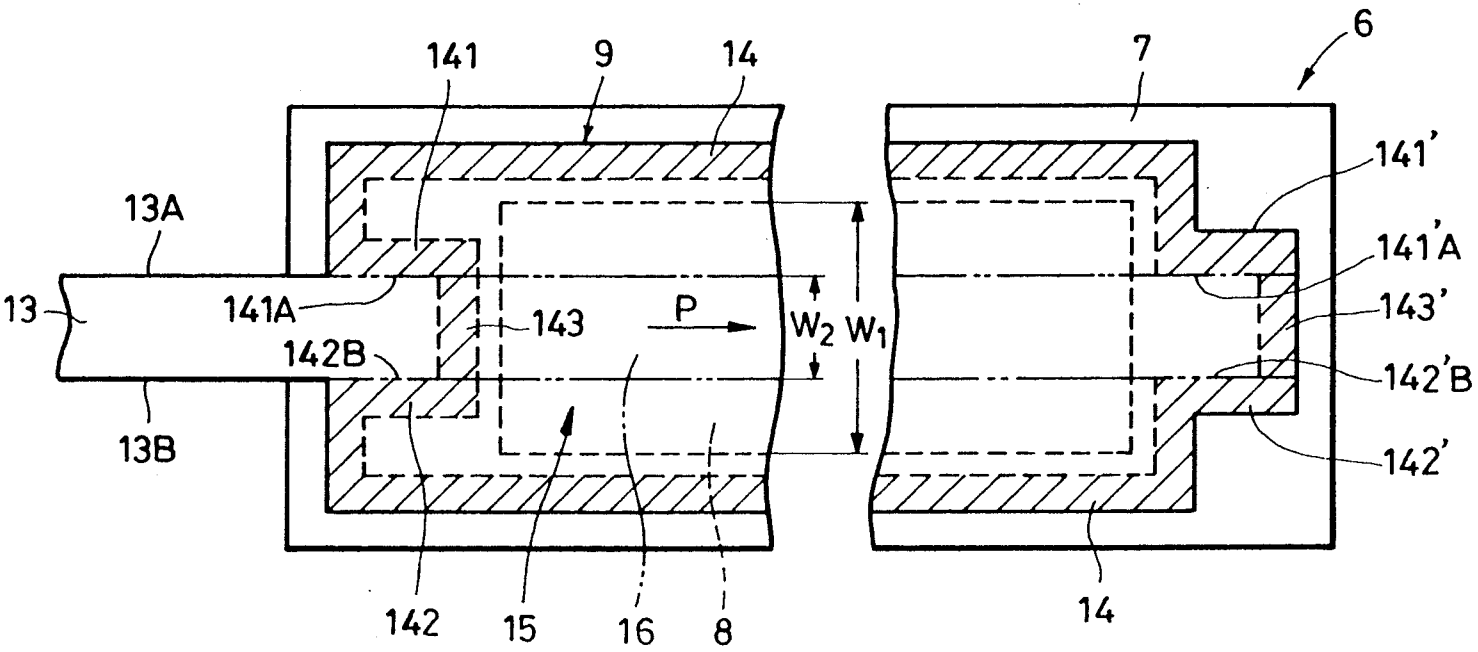
FIG. 6 is a bottom view of a developer container according to still another embodiment of the present invention.

FIG. 6 shows still another embodiment of the present invention. The adhesion area 14 comprises a box-like area composed of areas 141', 142' and 143', similar to the areas 141, 142 and 143 as described above, at the final end portion where the tearing-off operation comes to an end. The areas 141' 142' and 143' in this embodiment provide an effect similar to that of the areas 144, 145 and 146 in the above embodiment.

Figure 8:
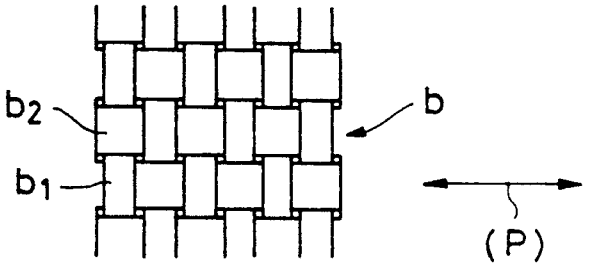
FIG. 8 illustrates flat yarn cloth.

The sealing member 9 employed in each of the above embodiments comprises a flat yarn cloth b as shown in FIG. 8. The flat yarn cloth b is woven of relatively wide flat-yarns $b_2$ and relatively narrow flat-yarns $b_1$, which cross each other substantially at a right angle. Polypropylene or other materials may be used to form the flat yarns.

The flat yarn cloth is easy to tear in a direction perpendicular to the length direction of the narrow flat yarns $b_1$ (such direction is indicated by the arrow (P) in FIG. 8), and hard to tear along the length of the narrow flat yarns $b_1$.

It is preferable that the gaps in the flat yarn cloth b be filled with polyethylene or silicon resin in order to increase the above-described easiness to tear.

Figure 7:
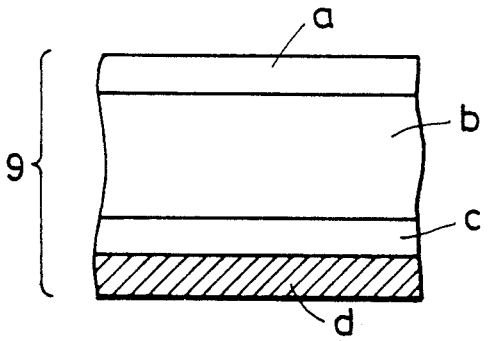
FIG. 7 illustrates a laminate used as a sealing member of an embodiment of the present invention.

It is difficult to weld the polypropylene flat yarn cloth b filled with polyethylene or silicon resin directly to the container body 6 because such flat yarn cloth does not have a heat resistance sufficient to withstand the heat sealing. Therefore, as shown in FIG. 7, both surfaces of the flat yarn cloth b are dry-laminated with uniaxially stretched films a and c of thermoplastic resin such as polypropylene, polyethylene terephtalate, etc. in order to add heat resistance. When the films a and c are layered on the flat yarn cloth b, the direction of the uniaxial stretching of each of the films a and c must coincide with the easy-to-tear direction of the polypropylene flat yarn cloth (the direction perpendicular to the narrow flat yarns). This is because a uniaxially stretched film is easy to tear in the stretch direction, and hard to tear perpendicularly thereto.

Polyolefine hot-melt adhesive d is layered by extrusion, i.e. by wet-laminating, on either one of the surfaces of the laminate composed of the films a, b and c, e.g. on the surface of the film c as shown in FIG. 7, to form the sealing member 9.

The sealing member 9 is heat-welded to the adhesion area 14 of the container body 6, with the hot-melt adhesive layer d being in contact with the adhesion area 14.

The bond strength of the polyolefine hot-melt adhesive d to the adhesion area 14 must be greater than the tear strength of the sealing member 9. Also, the thickness of the polyolefine hot-melt adhesive layer d must be restricted so as not to significantly increase the tear strength of the sealing member 9. The thickness of the adhesive layer d is in an approximate range from 20 to 100 μm. However, the tear strength of the polypropylene flat yarn cloth is 50 to 200 g, and that of each of the uniaxially stretched films of polypropylene or polyethylene terephtalate is very small, i.e. 50 g or less. Therefore, the polyolefine hot-melt adhesive to be used can be selected from a wide variety.

If the flat yarn cloth b is made of a material having a heat resistance sufficient to withstand heat sealing, the film a and/or the film c as shown in FIG. 7 is unnecessary. If the sealing member 9 is fixed to the container body 6 by an adhesive not requiring heat-welding, the adhesive layer d, as well as the film a and/or the film c, is unnecessary.

In the first embodiment, the sealing member 9 was formed by: using polyethylene to fill the gaps in the flat yarn cloth b (having a thickness of 110 μm), which was plain-woven using a 1.8 mm-wide weft $b_2$ of polypropylene flat yarns and a 1.2 mm-wide warp $b_1$ thereof as shown in FIG. 8; dry-laminating both surfaces of the flat yarn cloth b with uniaxially stretched films a and c, of a thermoplastic high molecular compound, such as films of polypropylene (PLYEN EM-H having a thickness of 20 μm, made by Toyobo); laminating the surface of the film c by extruding thereon a polyolefine hot-melt adhesive (containing 20% ethylene-vinylacetate) d as thick as 50 μm; and cutting such a laminate into a sealing member 9 as shown in FIG. 4. The formed sealing member 9 is heat-welded to the adhesion area 14 of the bottom board 7 of the developer container body 6 which is formed by extruding polyphenylene oxide. The heat sealing pattern is made as shown in FIG. 3.

The second embodiment uses substantially the same materials as in embodiment 1, the heat sealing pattern is made as shown in FIG. 5.

The third embodiment uses substantially the same materials as in embodiment 1, the heat sealing pattern is made as shown in FIG. 6.

An example of heat sealing uses laminate that is formed by laminating a uniaxially stretched polypropylene film (having a thickness of 25 mm) by extruding thereon a polyolefine hot-melt adhesive (containing 20% ethylene-vinylacetate) as thick as 50 μm. The laminate is cut into a sealing member in the shape shown in FIG. 4. The heat sealing pattern, i.e. the adhesion area, is made a substantially rectangular shape, i.e. the shape similar to that shown in FIG. 3 but not having a box-like area as composed of the areas 141, 142 and 143.

The tear strip portion 16 of each of the above embodiments and example was torn off from the main portion 15 by pulling the tip of the leader portion 13 in the direction indicated by the arrow P at a speed of 200 mm/min. The result of these embodiments is shown in the following table, where: p.A indicates the area where the tearing of the tear strip portion is started; p.C indicates the area where the tearing of the tear strip portion is completed; and p.B indicates the area between the above two areas.

Table of the Test Results

| CONSTRUCTION (thickness:μm) | TEARING (g) p.A | TEARING (g) p.B | TEARING (g) p.C | OPENING (mm) p.A | OPENING (mm) p.B | OPENING (mm) p.C |
|---|---|---|---|---|---|---|
| EMBODIMENT 1 (heat sealing pattern 1) | | | | | | |
| Uniaxially Stretched PP Film (20) / PP Flat Yarn Cloth (110) / Uniaxially Stretched PP Film (20) / Adhesive (50) | 1650 | 150 | 1700 | 20 | 20 | 20 |
| EMBODIMENT 2 (heat sealing pattern 2) | | | | | | |
| Uniaxially Stretched PP Film (20) / PP Flat Yarn Cloth (110) / Uniaxially Stretched PP Film (20) / Adhesive (50) | 1650 | 150 | 1680 | 20 | 20 | 20 |
| EMBODIMENT 3 (heat sealing pattern 3) | | | | | | |
| Uniaxially Stretched PP Film (20) / PP Flat Yarn Cloth (110) / Uniaxially Stretched PP Film (20) / Adhesive (50) | 1650 | 150 | 1650 | 20 | 20 | 20 |
| EXAMPLE | | | | | | |
| Uniaxially Stretched PP Film (25) / Adhesive (50) | 1600 | 50 | 400 | 20 | 15 | 5 |

Since the embodiments 1, 2 and 3 were provided with areas 141 and 142, the tear strip portion 16 of the sealing member 9 of each of the embodiments was torn off from the main portion 15 substantially as straight as if paper were torn along the edge of a ruler pressed onto the paper. Because the course of the tearing and the width of the tear strip portion torn did not vary during the initiation of the tearing operation, the width of the tear strip portion torn was substantially the same throughout its length.

In the example, the course of the tearing and the width of the tear strip portion had a tendency to vary at the initiation of the tearing operation, and the width of the opening formed varied over the course of the tearing.

Although the developer cartridges removably mounted to the developer units have been described in the above embodiments, the present invention can also be applied to a process cartridge or a developer unit which is removably mounted to an image forming apparatus.

Figure 9:
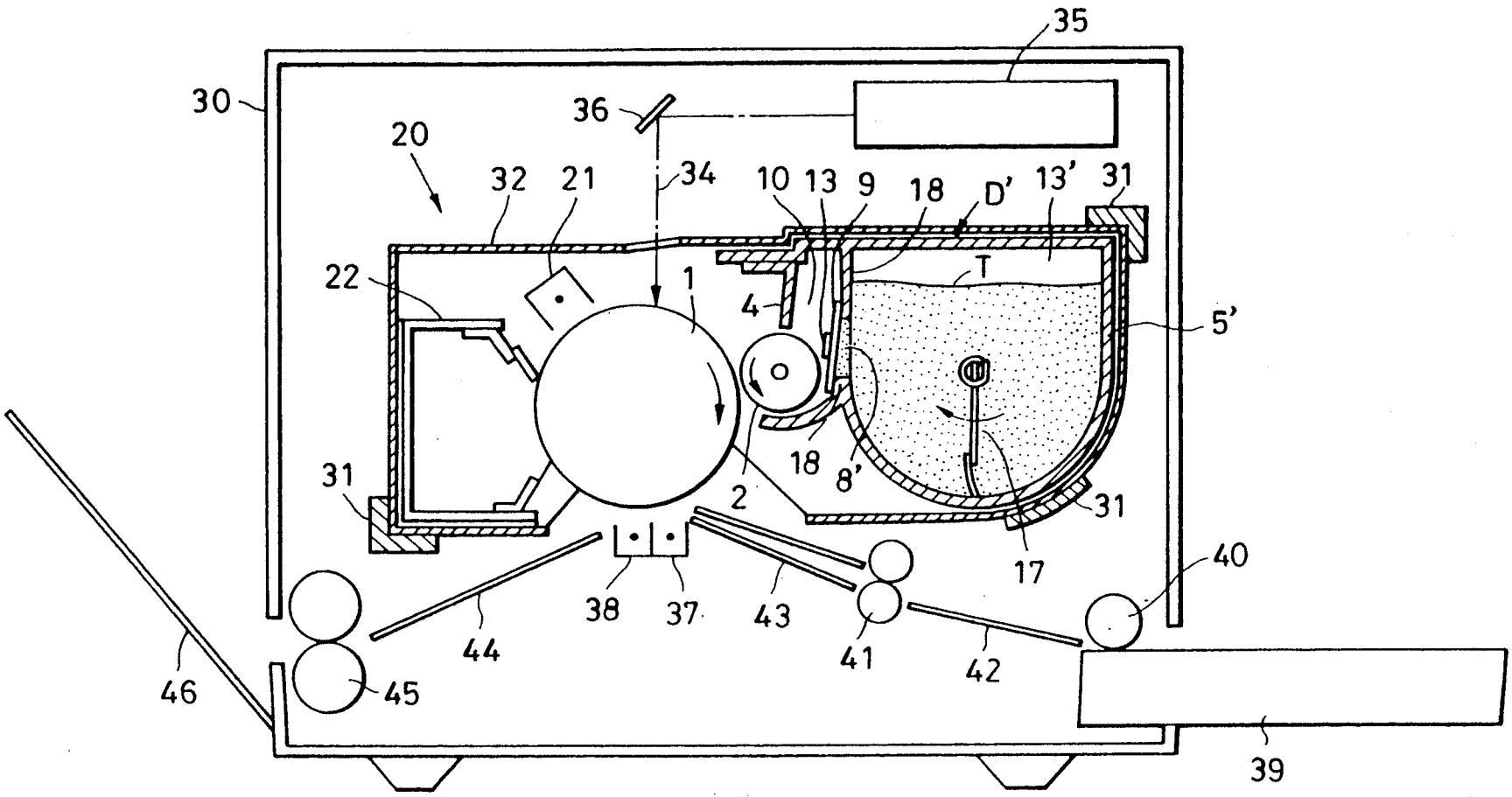
FIG. 9 illustrates a process cartridge according to the present invention.

Referring to FIG. 9, an image forming apparatus 30 comprises: optical devices 35 and 36; transfer member conveying devices 39–44; transfer device 37 and 38; a fixing device 45; and guide members 31, which guides a process cartridge 20 to be mounted to and removed from the apparatus 30.

The process cartridge 20 comprises: an electrophotographic photosensitive member 1 which is rotated in the direction indicated by the arrow; a charger unit 21 for evenly charging the photosensitive member 1; a developer unit D for developing an electrostatic latent image formed on the photosensitive member 1; a cleaner unit 22 for removing the toner remaining on the surface of the photosensitive member 1 after the transfer of a developed image; and a casing 32 in which the above member and units are supported. The process cartridge 20 is set in or removed from the apparatus 30 by sliding it along the guide members 31. Thus, when practically all the developer in the developer unit D is used up, an operator takes out the process cartridge 20 from the apparatus 30 and sets in another process cartridge 20 whose developer unit D is filled with developer. An image of a desired color can be easily produced by setting in the process cartridge storing a developer of the desired color.

The developer unit D comprises: a developer storing chamber 13' which stores developer T; a rotatable stirrer member 17 provided inside the storing chamber 13'; a development chamber 10; and a development roller 2 provided at the development chamber 10. The storing chamber 13' and the development chamber 10 are formed in a container 5' and separated by a wall 18.

The stirrer member 17 is rotated in the direction indicated by the arrow so as to stir the developer T inside the storing chamber 13' and convey the developer T into the development chamber 10 through an opening 8' provided in the separating wall 18. The development roller 2 is rotated in the direction indicated by the arrow to carry the developer T supplied into the development chamber 10 to a development area, where the developer on the developer roller 2 is applied to the photosensitive member 1 carrying an electrostatic latent image formed thereon. The image is thus developed.

An unused process cartridge 20 has a sealing member 9 fixed to the separating wall 18 of the container 5' in a manner as described above. The sealing member 9, having an intact tear strip portion 16 (shown in FIGS. 2–6), keeps the opening 8' sealed, preventing the leakage of developer. Thus, no developer is lost before use and the cartridge 20 is not stained on its inside or outside. Although not shown in FIG. 9, the tip of the above-described leader portion 13 sticks out of the casing 32. An operator, gripping the tip of the leader portion 13, pulls it to tear off the tear strip portion 16 from the main portion 15 (shown in FIGS. 2–6) either before or after setting the cartridge 20 in the apparatus 30. Thus, the opening 8' is opened, through which the developer T can be conveyed from the storing chamber 13' into the development chamber 10. In other words, the cartridge 20 is set ready to be used.

The image forming operation will now be described. The photosensitive member 1 is charged by the charger unit 21, and then exposed to a scanning laser beam 34 modulated according to information signals of an image to be recorded. An electrostatic latent image is thus formed on the photosensitive member 1. The laser beam 34 is generated by a known means including a semiconductor laser, a rotary polygon mirror, an f-$\theta$ lens, etc., and reflected by a mirror 36 to the photosensitive member 1.

The electrostatic latent image is developed by the developer unit D, as described above. The toner image thus obtained on the photosensitive member 1 is transferred to a transfer member such as paper by the effect of a transferring charger unit 37. The transfer member is separated from the photosensitive member 1 by the effect of a separating charger unit 38.

The transfer member conveying device comprises: a cassette 39 for storing transfer members; a pick-up roller 40 for sending out a transfer member from the cassette 39; registration rollers 41 for feeding the transfer member to a transfer area, synchronously with the toner image being carried to the transfer area by the photosensitive member 1; and conveyance guides 42, 43 and 44.

The transfer member separated from the photosensitive member 1 is conveyed through the guide 44 to a fixing device 45, which fixes the toner image on the transfer member. Then, the transfer member with the fixed toner image is discharged onto a tray 46.

Although the photosensitive member 1 is exposed to the laser beam in the apparatus shown in FIG. 9, it may be exposed to light emitted from a light-emitting diode array, or to the light directly from the image of a document through lenses. Also, a process cartridge lacking the charger unit 21 and/or cleaner unit 22 may be employed.

Figure 10:
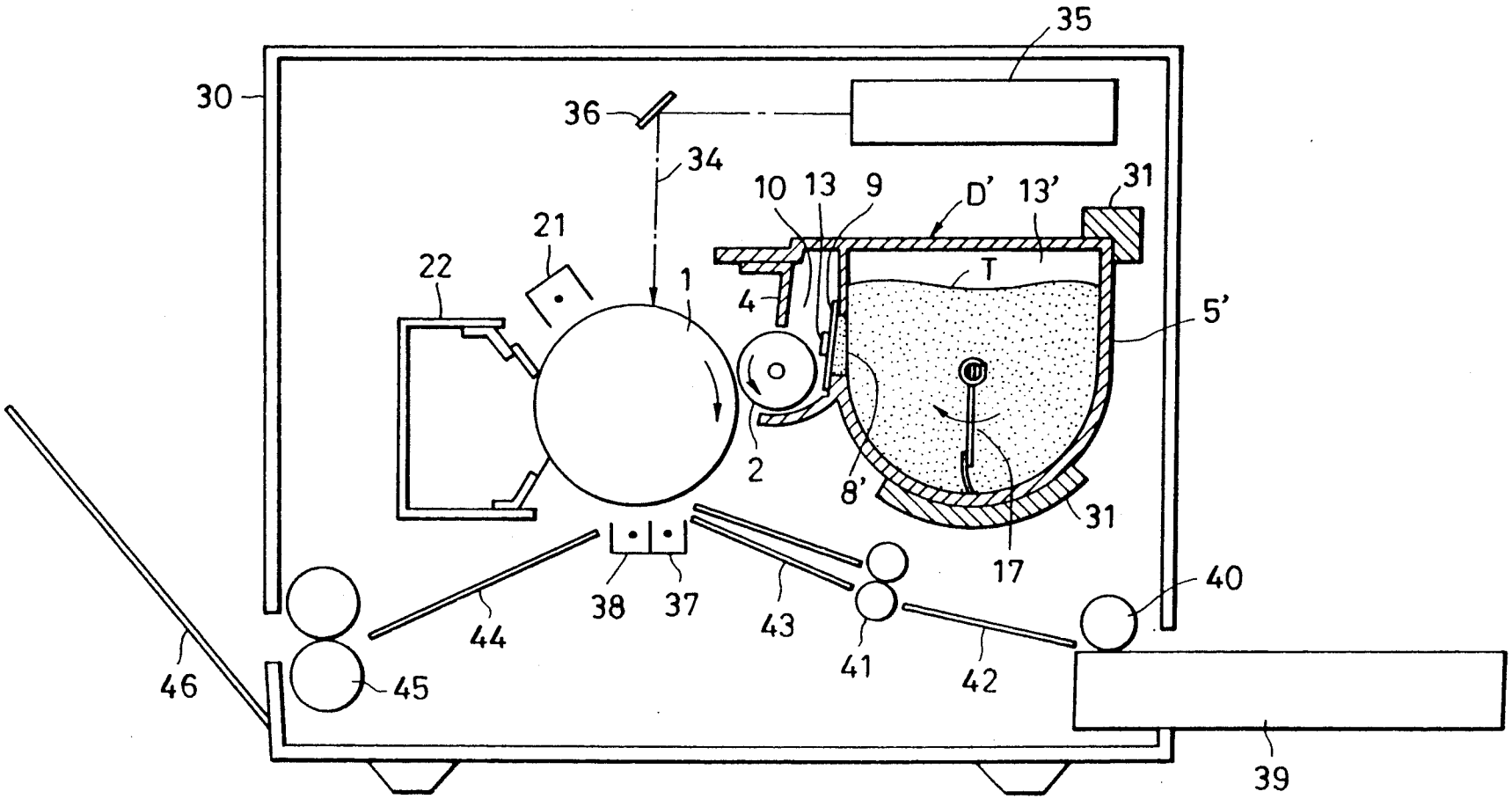
FIG. 10 illustrates a developer unit according to the present invention.

In FIG. 10, the members, units and means having the same functions as those in FIG. 9 are denoted by the same numerals employed in FIG. 9, and the description thereof will be omitted.

Referring to FIG. 10, an image forming apparatus 30 comprises a developer unit D which is separated from a photosensitive member 1, unlike the apparatus shown in FIG. 9. The developer unit D is set into and removed from the apparatus 30 by sliding it along guides 31. When practically all the developer T in the developer unit D is used up, an operator takes out the developer unit D from the apparatus 30 and sets in another developer unit D whose storing chamber 13' is filled with developer. A developed image of a desired color can be easily obtained by setting in the developer unit D storing a developer of the desired color. The construction of the developer unit D is as has already been described.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer container comprising:

a container body for storing a developer with which an electrostatic latent image is developed, said container body comprising an opening through which the developer is let out and an adhesion area surrounding said opening; and a sheet-like sealing member being easy to tear in a direction substantially parallel to one straight line, said sheet-like sealing member comprising a main portion, which is adhered to said adhesion area of said container body so as to seal said opening, a tear strip portion, which is a part of said main portion and is torn off in a predetermined direction that is substantially parallel to the straight line, and a leader portion which extends from said tear strip portion of the main portion and which is folded back and laid in the predetermined direction, wherein said adhesion area comprises a box-like area recessed in the predetermined direction, at a location facing a portion of said main portion that is adjacent to a base portion of said leader portion.

2. A developer container according to claim 1, wherein said box-like area comprises first and second areas whose lengths are parallel to the straight line and a third area whose length intersects with the straight line, wherein one edge line along a length of said leader portion of said sheet-like sealing member coincides with a line extended from an outside edge line of said first area, and another edge line along said leader portion of said sheet-like sealing member coincides with a line extended from an outside edge line of said second area.

3. A developer container according to claim 1, wherein said sheet-like sealing member comprises a flat yarn cloth which is easy to tear in a direction parallel to the straight line.

4. A developer container according to claim 3, wherein said flat yarn cloth is laminated with a uniaxially stretched resin film so that the direction of the uniaxial stretching of said resin film coincides with the direction of the straight line.

5. A developer container according to claim 4, wherein said sheet-like sealing member comprises a hot-melt adhesive layer, where said sheet-like sealing member is welded to said adhesion area, with said hot-melt adhesive layer being in contact with a surface of the adhesion area.

6. A developer container according to claim 2, wherein said sheet-like sealing member comprises a flat yarn cloth which is easy to tear in a direction parallel to the straight line.

7. A developer container according to claim 6, wherein said flat yarn cloth is laminated with a uniaxially stretched resin film so that the direction of the uniaxial stretching of said resin film coincides with the direction of the straight line.

8. A developer container according to claim 7, wherein said sheet-like sealing member comprises a hot-melt adhesive layer, where said sheet-like sealing member is welded to said adhesion area, with said hot-melt adhesive layer being in contact with a surface of the adhesion area.

9. A developer unit for developing an electrostatic latent image, comprising:

a developer conveying member for carrying developer to a development area;

a container comprising a first chamber where said developer conveying member is placed and which stores the developer to be applied to the developer conveying member, a second chamber which stores the developer to be supplied into said first chamber, an opening through which the developer is conveyed from said second chamber to said first chamber, and an adhesion area surrounding the opening;

a sheet-like sealing member being easy to tear in a direction substantially parallel to one straight line, said sheet-like sealing member comprising a main portion, which is adhered to said adhesion area of said container so as to seal said opening, a tear strip portion, which is a part of said main portion and is torn off in a predetermined direction that is substantially parallel to said straight line, and a leader portion which extends from said tear strip portion of the main portion and which is folded back and laid in said predetermined direction, wherein said adhesion area has a box-like area recessed in said predetermined direction, at a location facing a portion of said main portion adjacent to a base portion of said leader portion.

10. A developer unit according to claim 9, wherein said box-like area comprises first and second areas whose lengths are parallel to the straight line and a third area whose length intersects with the straight line, wherein one edge line along a length of said sheet-like leader portion of the sealing member coincides with a line extended from the outside edge line of said first area, and another edge line along said leader portion of the sheet-like sealing member coincides with a line extended from an outside edge line of said second area.

11. A developer unit according to claim 9, wherein said sheet-like sealing member comprises a flat yarn cloth which is easy to tear in a direction parallel to the straight line.

12. A developer unit according to claim 11, wherein said flat yarn cloth is laminated with a uniaxially stretched resin film so that the direction of the uniaxial stretching of said resin film coincides with the direction of the straight line.

13. A developer unit according to claim 12, wherein said sheet-like sealing member comprises a hot-melt adhesive layer, where the sealing member is welded to said adhesion area, with said hot-melt adhesive layer being in contact with a surface of the adhesion area.

14. A developer unit according to claim 10, wherein said sheet-like sealing member comprises a flat yarn cloth which is easy to tear in a direction parallel to the straight line.

15. A developer unit according to claim 14, wherein said flat yarn cloth is laminated with a uniaxially stretched resin film so that the direction of the uniaxial stretching of said resin film coincides with the direction of the straight line.

16. A developer unit according to claim 15, wherein said sheet-like sealing member comprises a hot-melt adhesive layer, where the sealing member is welded to said adhesion area, with said hot-melt adhesive layer being in contact with a surface of the adhesion area.

17. A process cartridge removably attachable to an image forming apparatus, comprising:

an image carrier for carrying an electrostatic latent image; and a developer unit for applying developer to said image carrier in a development area so as to develop the electrostatic latent image, said developer unit comprising:

a developer conveying member for carrying developer to a development area;

a container comprising a first chamber where said developer conveying member is placed and which stores the developer to be applied to the developer conveying member, a second chamber which stores the developer to be supplied into said first chamber, an opening through which the developer is conveyed from said second chamber to said first chamber, and an adhesion area surrounding the opening;

a sheet-like sealing member being easy to tear in a direction substantially parallel to one straight line, said sheet-like sealing member comprising a main portion, which is adhered to said adhesion area of said container so as to seal said opening, a tear strip portion, which is a part of said main portion and is torn off in a predetermined direction that is substantially parallel to said straight line, and a leader portion which extends from said tear strip portion of the main portion and which is folded back and laid in the predetermined direction, wherein said adhesion area comprises a box-like area recessed in the predetermined direction, at a location facing a portion of said main portion that is adjacent to a base portion of said leader portion.

18. A process cartridge according to claim 17, wherein said box-like area comprises first and second areas whose lengths are parallel to the straight line and a third area whose length intersects with the straight line, wherein one edge line along a length of said leader portion of the sealing member coincides with a line extended from the outside edge line of said first area, and another edge line along said leader portion of said sheet-like sealing member coincides with a line extended from an outside edge line of said second area.

19. A process cartridge according to claim 17, wherein said sheet-like sealing member comprises a flat yarn cloth which is easy to tear in a direction parallel to the straight line.

20. A process cartridge according to claim 19, wherein said flat yarn cloth is laminated with a uniaxially stretched resin film so that the direction of the uniaxial stretching of said resin film coincides with the direction of the straight line.

21. A process cartridge according to claim 20, wherein said sheet-like sealing member comprises a hot-melt adhesive layer, where said sheet-like sealing member is welded to said adhesion area, with said hot-melt adhesive layer being in contact with a surface of the adhesion area.

22. A process cartridge according to claim 18, wherein said sheet-like sealing member comprises a flat yarn cloth which is easy to tear in a direction parallel to the straight line.

23. A process cartridge according to claim 22, wherein said flat yarn cloth is laminated with a uniaxially stretched resin film so that the direction of the uniaxial stretching of said resin film coincides with the direction of the straight line.

24. A process cartridge according to claim 23, wherein said sheet-like sealing member comprises a hot-melt adhesive layer, where said sheet-like sealing member is welded to said adhesion area, with said hot-melt adhesive layer being in contact with a surface of the adhesion area.

* * * * *

UNITED STATES PATENT AND TRADEMARK OFFICE

CERTIFICATE OF CORRECTION

PATENT NO. :5,177,540

DATED :January 5, 1993

INVENTOR(S) :HONDA et al.

It is certified that error appears in the above-indentified patent and that said Letters Patent is hereby corrected as shown below:

On the title page:

[56] References Cited

"5,110,645 5/1992 Prestel et al." should read --5,110,646 5/1992 Prestel et al.--.

Signed and Sealed this

Eleventh Day of January, 1994

Bruce Lehman

*Attest:*

BRUCE LEHMAN

*Attesting Officer*

*Commissioner of Patents and Trademarks*